US005727783A

United States Patent [19]

Tassinari

[11] Patent Number: 5,727,783

[45] Date of Patent: Mar. 17, 1998

[54] APPARATUS FOR DELIVERY OF SHEETS OF PRINTED PRODUCTS

[75] Inventor: Peter Roy Tassinari, Kennebunkport, Me.

[73] Assignees: Heidelberger Druckmaschinen AG, Heidelberg, Germany; Heidelberg Harris, Inc., Dover, N.H.

[21] Appl. No.: 827,876

[22] Filed: Apr. 3, 1997

Related U.S. Application Data

[63] Continuation of Ser. No. 504,867, Jul. 20, 1995, abandoned.

[51] Int. Cl.[6] ..... B65H 5/16

[52] U.S. Cl. ..... 271/185; 271/182; 271/204

[58] Field of Search ..... 271/82, 182, 184, 271/185, 204–206, 225, 270, 277, 314, 315; 198/377, 470.1

[56] References Cited

U.S. PATENT DOCUMENTS

| | | | |
|---|---|---|---|
| 3,236,162 | 2/1966 | Reist | 271/185 X |
| 3,459,421 | 8/1969 | Motter | 271/82 X |
| 3,671,035 | 6/1972 | Reist | 271/185 X |
| 3,809,214 | 5/1974 | Reist | 271/185 X |
| 4,205,837 | 6/1980 | von Hein et al. . | |
| 4,565,363 | 1/1986 | Faltin . | |
| 4,886,260 | 12/1989 | Reist . | |
| 5,443,254 | 8/1995 | Reht | 271/184 X |
| 5,452,886 | 9/1995 | Cote et al. | 271/82 X |

FOREIGN PATENT DOCUMENTS 0 033 300 1/1981 European Pat. Off. .

*Primary Examiner*—Boris Milef
*Attorney, Agent, or Firm*—Kenyon & Kenyon

[57] ABSTRACT

An apparatus for delivery of sheet-like products is provided which includes a reorientating conveyer 14 coupled to deceleration unit 6, the deceleration unit 6 for receiving signatures 5 from a product forming device such as a folding or a cutting cylinder. The deceleration unit 6 slows down the signatures 5 from a single spaced configuration to an overlapped shingled configuration. The reorientation conveyer 14 grips signatures in an overlapped shingled configuration with grippers 17, the grippers 17 having a pitch 16. Since the deceleration unit 6 does not release the signatures 5 until after the grippers 17 are engaged, control over the signatures is maintained during the transfer. In the reorientation conveyer 14, the grippers 17 rotate the signatures into a spine leading formation while maintaining control over the signatures 5. A transport conveyer 22, including grippers 25 having a smaller pitch 23, receives the signatures from the reorientation conveyer 14, thereby changing the spacing between the shingled signatures to correspond to pitch 23. The transport conveyer 22 travels substantially parallel to the reorientation conveyer 14 over a second transfer area 24. Grippers 17 of the reorientation conveyer do not release the signatures 5 until after grippers 25 of the transport conveyer 22 are engaged, thereby maintaining control over the signatures throughout the transfer.

20 Claims, 6 Drawing Sheets

24
27
14
17
25
5
26
27
25
17
14

27
22
25
16
23
25
20
21
21
5
19
21
5
310
17
14
5
5
5
21
16
51

APPARATUS FOR DELIVERY OF SHEETS OF PRINTED PRODUCTS

This application is a continuation of application Ser. No. 08/504,867, filed on Jul. 20, 1995 now abandoned.

FIELD OF THE INVENTION

The present invention relates to an apparatus for delivery of sheets of printed products or signatures, from a folder, a cutting unit or other similar device.

BACKGROUND OF THE INVENTION

U.S. Pat. No. 4,886,260 purports to disclose a method and an apparatus for receiving folded printed products from a printing machine. This device has grippers secured to a chain structure arranged beneath a fan wheel. The grippers engage trailing edges of the products, abutting a stripper wheel. By means of a revolvingly driven belt engaging the trailing edges of the printed products these printed products are displaced prior to the engagement by the grippers.

U.S. Pat. No. 4,565,363 purports to show an apparatus for spacing a sequence of shingled paper sheet products on the conveyer. By means of movably positioning stripping stops moving into the path of the fan wheel engaging the paper products, a shingled formation of said paper products can purportedly be defined more accurately. The stripped products are shingled onto a conveyer belt, the spacing between the successive shingled paper products being defined at high speeds with products varying widely in weight and at various high speeds such as expected in newspaper operations.

U.S. Pat. No. 4,487,408 purports to disclose an unit for parallelizing a chain of signatures at the delivery end of a printing press. By means of a driver being moved at a higher speed than the signatures, the signatures are placed regularly onto a delivery belt. The drivers contact the signatures trailing edges as their leading edge contact the delivery belt.

EP Application No. 0 033 300 A2 purports to disclose a gripping device for a chain-delivery system in rotary printing presses. By means of this device products are seized being taken out of fan pockets and delivered on a delivery belt arrangement.

U.S. Pat. No. 4,205,837 purports to show an apparatus for forming a succession of mutually overlapping products. A chain extends between two neighboring discs of a fan wheel arrangement, the chain having a plurality of gripper elements spaced along the chain. Each of these gripper elements grip a corresponding product and carry this product to a transport so that the printed products are overlapped on the transport.

The configurations outlined above all suffer from the disadvantage that they do not address that subsequent reorientation, retiming, and pacing of the signatures which is required for further processing. For example, it is generally necessary to re-orient signatures to a spine-leading configuration after folding. Similarly, it is often necessary to re-time or pace the signatures, e.g., change the spacing between overlapping signatures. During the course of this re-orientation, retiming or pacing of the signatures, a temporary loss of the gripped control occurs in prior art systems, increasing the risk that alignment of the signatures will be lost.

SUMMARY OF THE INVENTION

In accordance with a first embodiment of the present invention, an apparatus for delivery of sheet-like products is provided which includes a deceleration unit and a reorienting mechanism. The deceleration unit receives signatures from an upstream portion of a folder or similar device, for example, from a high speed tape. The deceleration unit includes a plurality of first grippers, each of the plurality of first grippers seizing a respective signature at a signature seizing area and releasing the respective signature at a first transfer area. The reorientation mechanism receives the signatures from the deceleration unit. The reorientation mechanism includes a plurality of second grippers, each of the plurality of second grippers seizing a respective signature from the deceleration unit before or at the same time that the respective signature is released by the deceleration unit. After a signature is seized by a second gripper, the second gripper reorients the signature before releasing the signature at a second transfer area.

Therefore, in contrast with prior art systems, in accordance with the present invention, the signatures are kept under constant control while they are transferred from the deceleration unit, reoriented, and transported to the first transfer area.

In accordance with a second embodiment of the present invention, the apparatus further includes a transport mechanism for receiving signatures from the reorientation mechanism. The transport mechanism includes a plurality of third grippers, each of the plurality of third grippers seizing a respective signature from the deceleration unit before, or at the same time, that the respective signature is released by the reorientation mechanism. In this manner, the signatures are kept under constant control during the transfer from the reorientation mechanism as well. Moreover, by selecting a pitch between (i.e. distance between) the second grippers which is greater than the pitch between the third grippers, the pacing of the signatures can be increased during the transfer from the reorientation mechanism to the transport mechanism without any loss of control over the signatures.

In accordance with a third embodiment of the present invention, the reorientation mechanism is constructed as a first rotating conveyer which follows a first conveyer path, a portion of the first conveyer path passing substantially parallel to the first transfer area. Each of the second grippers is mounted on the rotating conveyer. The gripping of the signatures by the second grippers can be controlled by providing a first trigger member at the first transfer area, and by providing a first actuating member on each second gripper. When the first actuating member passes the first trigger member, the second gripper will engage, and grip the signature.

Similarly, the transport mechanism may be constructed as a second rotating conveyer which follows a second conveyer path, wherein a portion of the second conveyer path passes substantially parallel to the first conveyer path at the second transfer area. Each of the third grippers is mounted on the second rotating conveyer. The gripping of the signatures by the third grippers can be controlled by providing a second actuating member on a side of each second gripper, and by providing a third actuating member on an adjacent side of each third gripper. When one of the second grippers passes one of the third grippers in the second transfer area, the third and fourth actuating members are depressed, thereby causing the third gripper to engage and causing the second gripper to disengage.

In accordance with a further embodiment of the present invention, each of the second grippers is mounted on the first conveyer via a pivot axis, and the signatures are reoriented by rotating the second grippers about their pivot axes into a spine leading configuration. Rotation of the second grippers may be actuated by providing a second trigger member at the position in the first conveyer path at which rotation is desired, and by providing a fifth actuating member on the second gripper which, when it passes over the second trigger member, causes the second gripper to rotate 90° in a plane substantially parallel to the path of the first conveyer. In addition, a fixed guide may be mounted along the portion of the first transport path in which the signatures are being reoriented. The fixed guide can be mounted below the first transport path to support the signatures, thereby preventing damage to the signatures during reorientation.

Moreover, in accordance with a still further embodiment of the present invention, the deceleration unit includes a plurality of pivot arms rotating around respective pivot axes, wherein each of the pivot axes rotates about a single central axis. Each of the first grippers is mounted to a respective pivot arm and travels along a deceleration path. The signature seizing area is located at a first arc-length along the deceleration path, and the first transfer area is located at a second arc-length along the deceleration path. The gripping and releasing of the signatures by the first grippers may be controlled by the position of the first grippers relative to the path of the deceleration unit.

As set forth above, the apparatus according to the present invention provides continuous control of the signature throughout transport from the deceleration unit, through the reorientation mechanism, and through the transport mechanism. As a result, damage to the trailing edges or other portions of said signatures is prevented.

Moreover, the need for a further processing station to reorient the signatures is eliminated because reorientation is accomplished during conveyance in the reorientation mechanism. In addition, since reorientation is accomplished without releasing control of the signatures, the risk of signature misalignment which is inherent in prior art systems is greatly reduced.

BRIEF DESCRIPTION OF THE DRAWINGS

FIG. 1(*b*) shows the manner in which a signature is transferred from the deceleration unit to the reorientation mechanism.

FIG. 1(*c*) shows a triggering member and an actuating member of the reorientation mechanism of FIGS. 1(*a,b*).

FIG. 2(*b*) shows the manner in which a signature is rotated by the reorientation mechanism.

FIG. 2(*c*) shows a triggering member and an actuating member of the reorientation mechanism of FIGS. 2(*a,b*).

FIG. 3(*b*) shows the manner in which a signature is transferred from the reorientation mechanism to the further transport mechanism.

DETAILED DESCRIPTION OF THE INVENTION

Figure 1A:
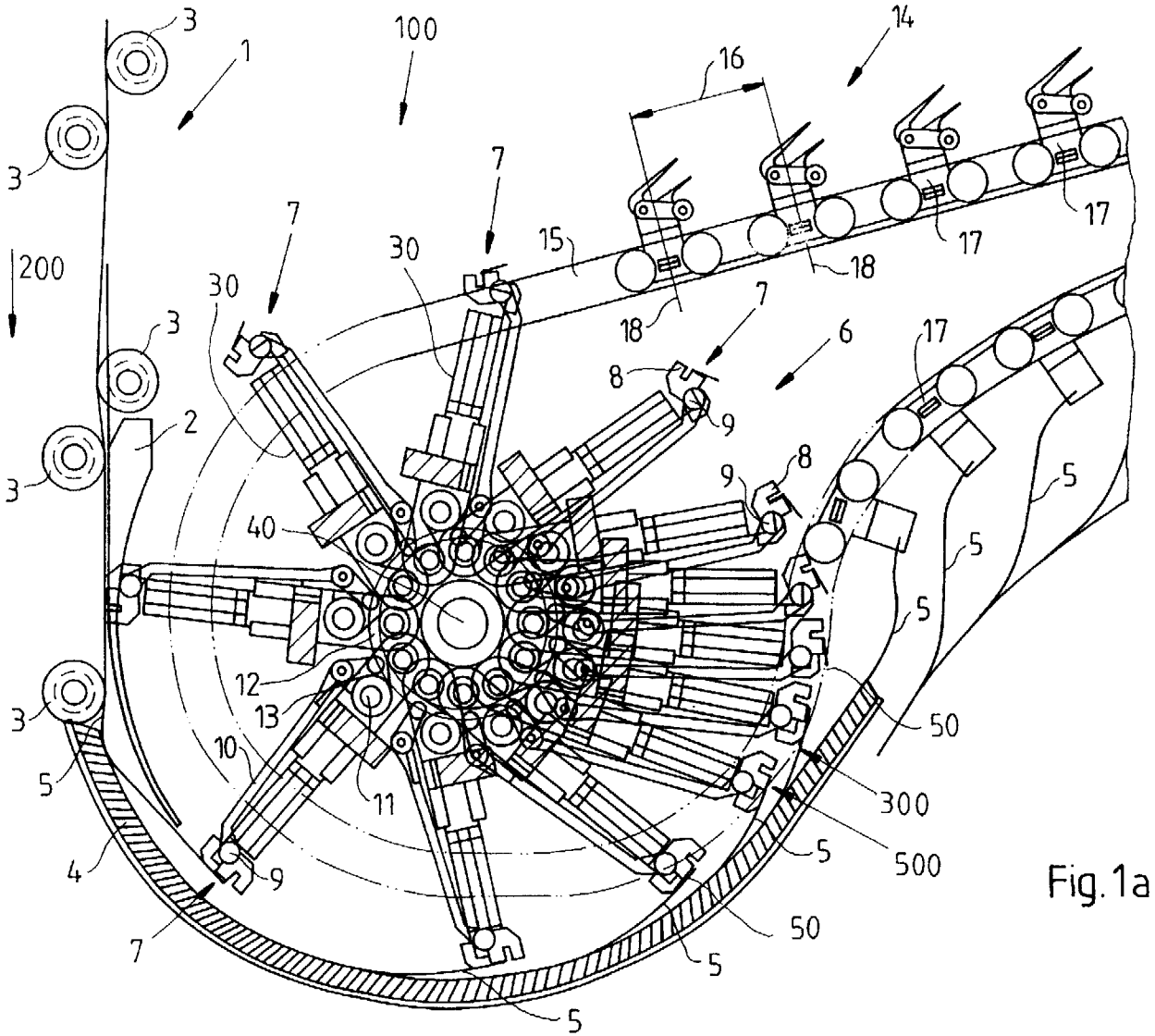
FIG. 1(*a*) shows a side view of a deceleration unit and reorientation mechanism of a conveying system according to the present invention.
Figures 1B, 1C:
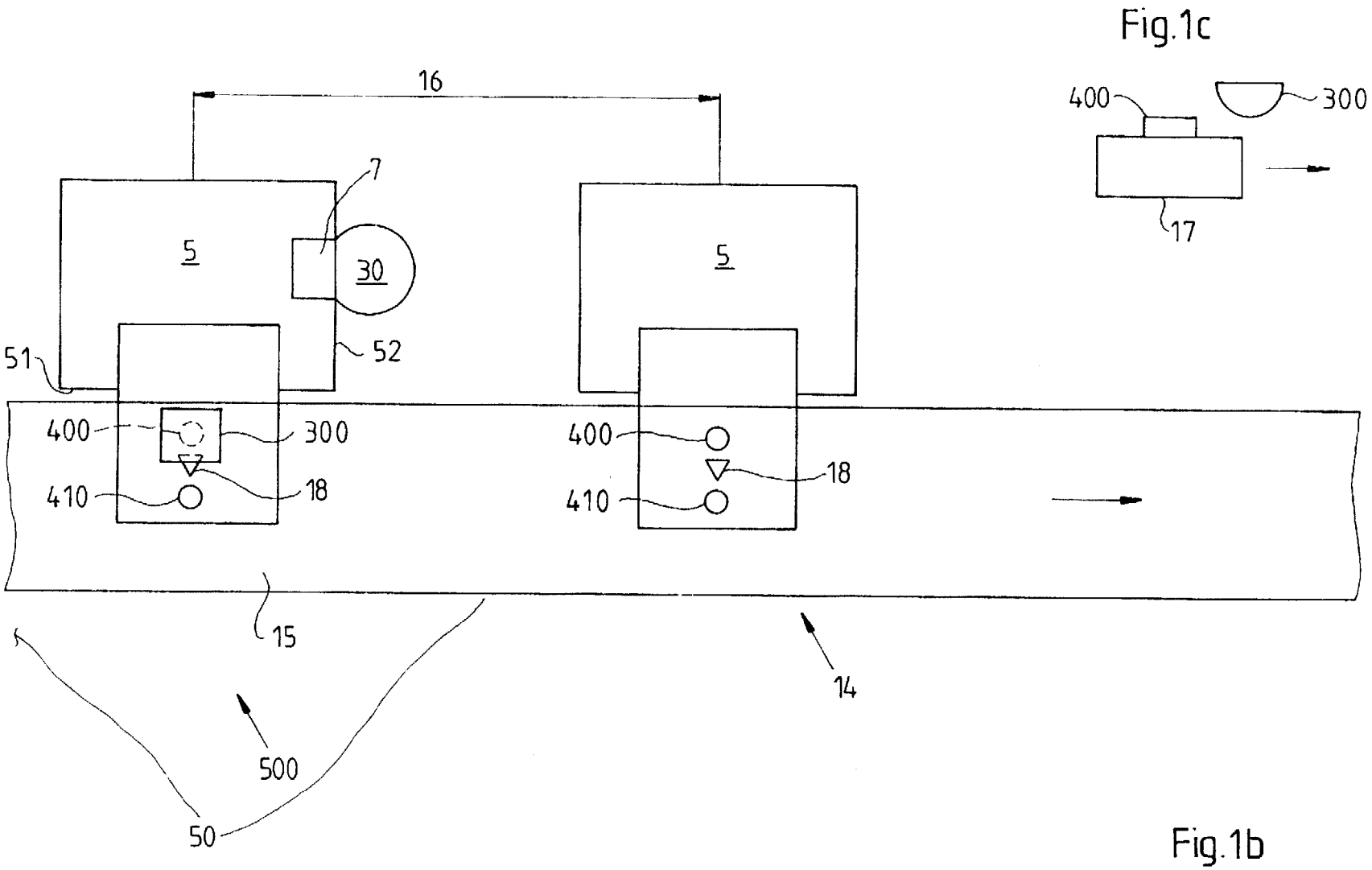

FIG. 1(*a*) shows a folder 100 including a conveying system according to an embodiment of the present invention. The conveying system includes a deceleration unit 6 and reorienting gripper conveyer 14.

The folder 100 includes a set of high speed tapes 1 which are guided by a variety of tape rollers 3. The high speed tapes transport signatures 5 in a transport direction 200. The signatures emerge from the high speed tapes at fixed guide 2. Fixed guide 2 has a curved surface which guides the signatures 5 along an outer circumference of the deceleration unit 6. The deceleration unit 6 seizes the signatures 5 as they travel along the fixed guide 2. Brush guides 4 are provided beneath the deceleration unit 6 to keep the signatures 5 from buckling as they are transported by the deceleration unit 6 to the reorienting gripper conveyer 14.

Any conventional deceleration unit can be used in accordance with the present invention. In accordance with a preferred embodiment of the present invention, however, the deceleration unit 6 includes a plurality of gripping heads (grippers) 7 mounted on respective ends of pivot arms 30. Each gripping head 7 includes a finger-shaped element 8 pivotable about a pivot axis 9. An actuating rod 10 is coupled to the pivot axis 9 for pivoting the gripping head 7 about the pivot axis 9. The actuating rod 10 is also coupled to a lever linkage 13 having a cam follower 11. Upon rotation of said gripping heads 7 about a center axis 40 of the deceleration unit 6, the cam followers 11 contact a cam 12 being arranged eccentrically. As one of ordinary skill in the art will appreciate, the angular position (relative to the center axis 40) at which the gripping and releasing of the gripping head 7 occurs can be selected by properly configuring the cam 12, cam followers 11, and lever linkage 13.

The deceleration unit 6 shown in FIG. 1(*a*) is described in more detail in U.S. Pat. No. 5,452,886, entitled DEVICE FOR SLOWING DOWN SIGNATURES IN A FOLDING MACHINE, granted Sep. 26, 1995, the specification of which is hereby incorporated by reference. Moreover, the alternative embodiments of the deceleration unit described in U.S. Pat. No. 5,452,886 are also applicable to the present invention.

Thus, upon rotation of said gripping heads 7 an opening and closing of said finger-shaped elements 8 is achieved, resulting in seizing a respective signature 5 at the fixed guide 2, and releasing the signature 5, at a first transfer area defined by an arc length 50, after its deceleration is completed.

The signatures 5 are conveyed in a single-spaced (not overlapped) configuration when they enter the deceleration unit 6, and, as a result of the deceleration, they are released in an overlapped shingled condition.

The reorienting gripper conveyer 14 (reorientation mechanism, reorientation conveyer) is engaged with the deceleration unit 6. The reorienting gripper conveyer 14 includes rotatable gripping elements 17 (grippers) mounted on a conveying track 15. The conveying track 15 rotates around the deceleration unit 6 in a counter-clockwise motion. The rotatable gripping elements 17 each have a rotation axis 18. Furthermore, the rotatable gripping elements 17 are arranged along the conveying track 15 such that there is a first pitch 16 between adjacent gripping elements 17.

As the conveying track 15 passes around the central axis 40 of the deceleration unit 6, the conveying track 15 is substantially parallel to the path followed by the grippers 7 along the first transfer area 500 defined by the arc length 50. This allows for a seizing of said signatures 5 by the rotatable gripping elements 17.

As the deceleration unit 6 rotates, the finger-shaped elements 8 of the gripper head 7 are actuated by the cam 12, releasing the slowed down signatures 5 from the deceleration unit 6 before the signature 5 exits the arc length 50. However, the rotatable gripping elements 17 seize the spine of the signature 5 as the signature travels through the arc length 50. Referring to FIG. 1(*b*), the gripping element 17 grips the backbone 51 of the signature 5 while the gripper 7 is still holding the right edge 52 of the signature 5.

As a result, the signature is transferred from the gripper 7 of the deceleration unit 6 to the rotatable gripping elements 17 of the reorientation mechanism while maintaining continuous control over the signature 5.

Figure 2A:
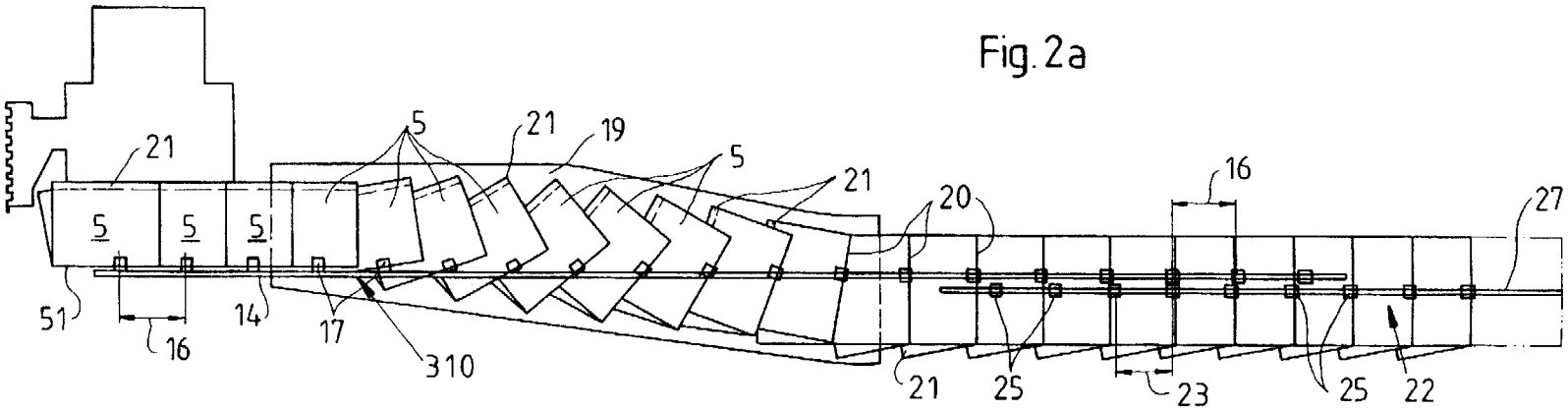
FIG. 2(*a*) shows the signature reorientation mechanism and a further transport mechanism of the conveying system according to the present invention.
Figure 2C:
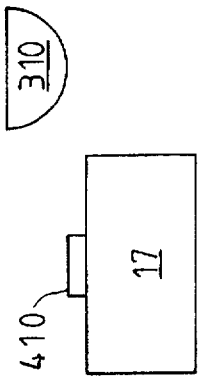
Figure 2B:
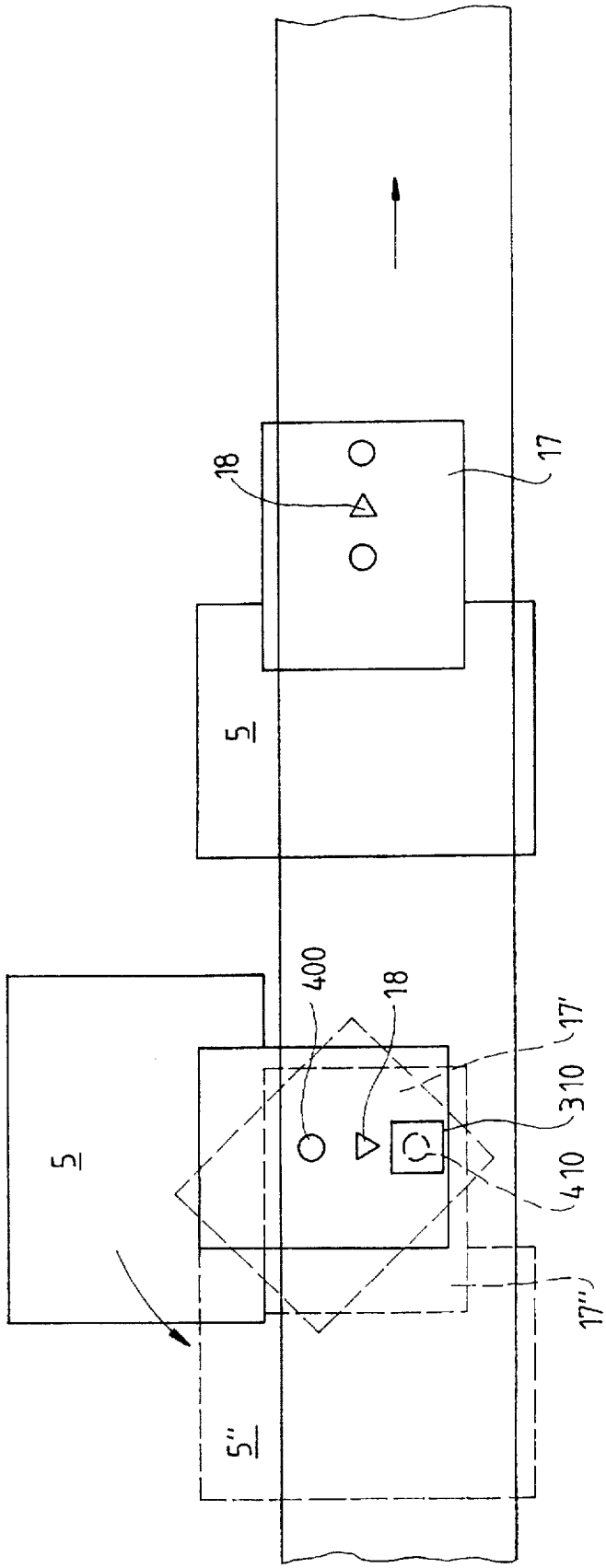

FIG. 2 (*a*) shows an overhead view of the reorientation conveyer gripper 14 and a transport conveyer 22. Referring to FIG. 2 (*a*), after the signatures are gripped at their backbone by grippers 17, the signatures 5 travel into a second fixed guide 19. As has been outlined above with regard to FIG. 1(*a*), the signatures 5 are conveyed at the output of the deceleration unit 6 in a shingled formation. Along the arc-length 50, the signatures 5 are seized by the rotatable grippers 17 having a first pitch 16.

As can be seen in FIG. 2(*a*) the backbone 51 and a trailing edge 21 of the signatures 5 are substantially parallel to each other. The reorienting gripper conveyer 14 moves the signatures 5 along the conveying track 15. The second fixed guide 19 is arranged below the conveying track, and supports the signatures 5 as they travel along the conveying track. Referring to FIG. 2(*a*), as they pass over the second fixed guide 19, the signatures 5 are reoriented by rotating the rotatable gripping elements 17 approximately 90° about the axis 18. As a result, a spine leading configuration during conveyance is achieved; i.e. the spine 51 of the signatures 5 is reoriented such that it becomes the leading edge in the conveying direction. As shown in FIG. 2(*a*), the width of second fixed guide increases at the position along the conveying track 15 at which rotation occurs. In this manner, the second guide 19 supports the signatures 5 throughout the rotation process, thereby preventing signature damage.

As the signatures 5 leave the second fixed guide 19, they are reoriented to a backbone leading configuration, having a first pitch 16, and being conveyed in a shingled formation.

A transport conveyer 22 is coupled to reorienting gripper conveyer 14. The transport conveyor 22 includes transport grippers 25 and a transport conveyer track 27. The transport grippers 25 are arranged in a second pitch 23 which is smaller than the first pitch 16 of the reorienting gripper conveyer 14. The transport grippers 25 are mounted on, and follow, the transport conveyer track 27 which travels at a speed which is less than the speed of the reorientation conveyer track 15.

Figure 3A:
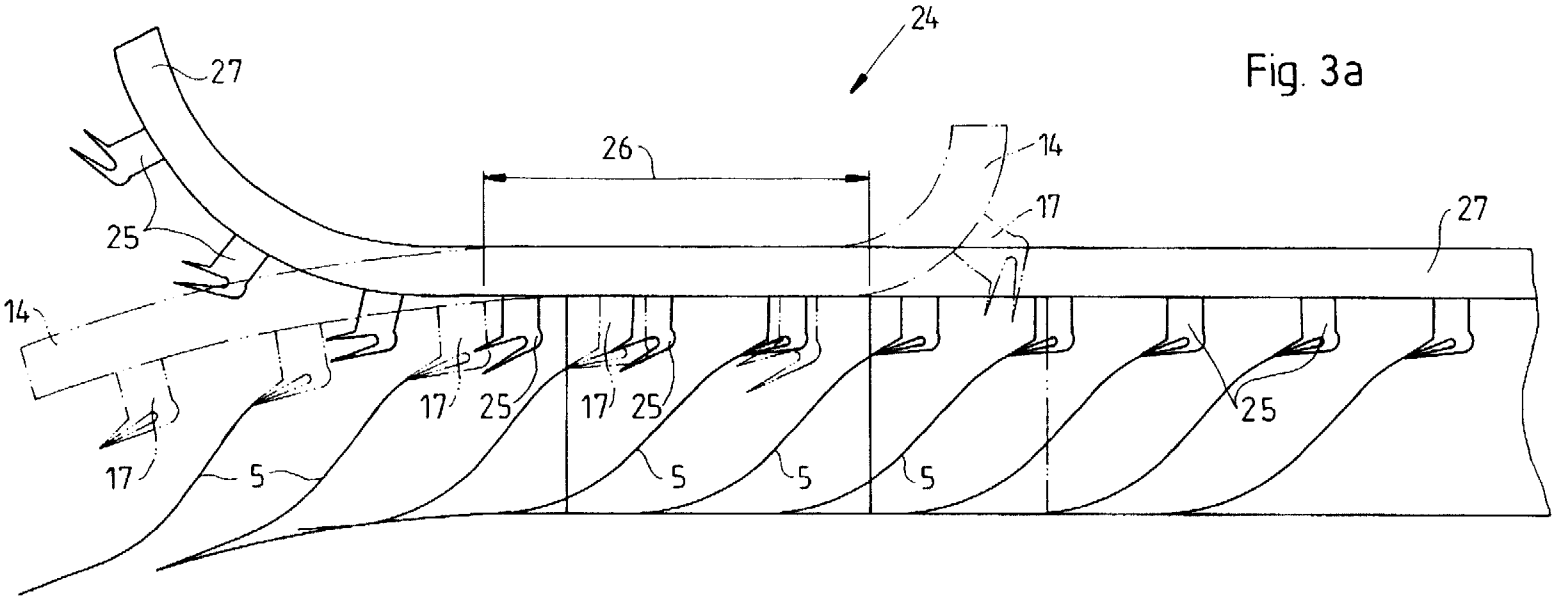
FIG. 3(*a*) shows the intersection of the signature reorientation mechanism and further transport mechanism of FIG. 2 in more detail.
Figure 3B:
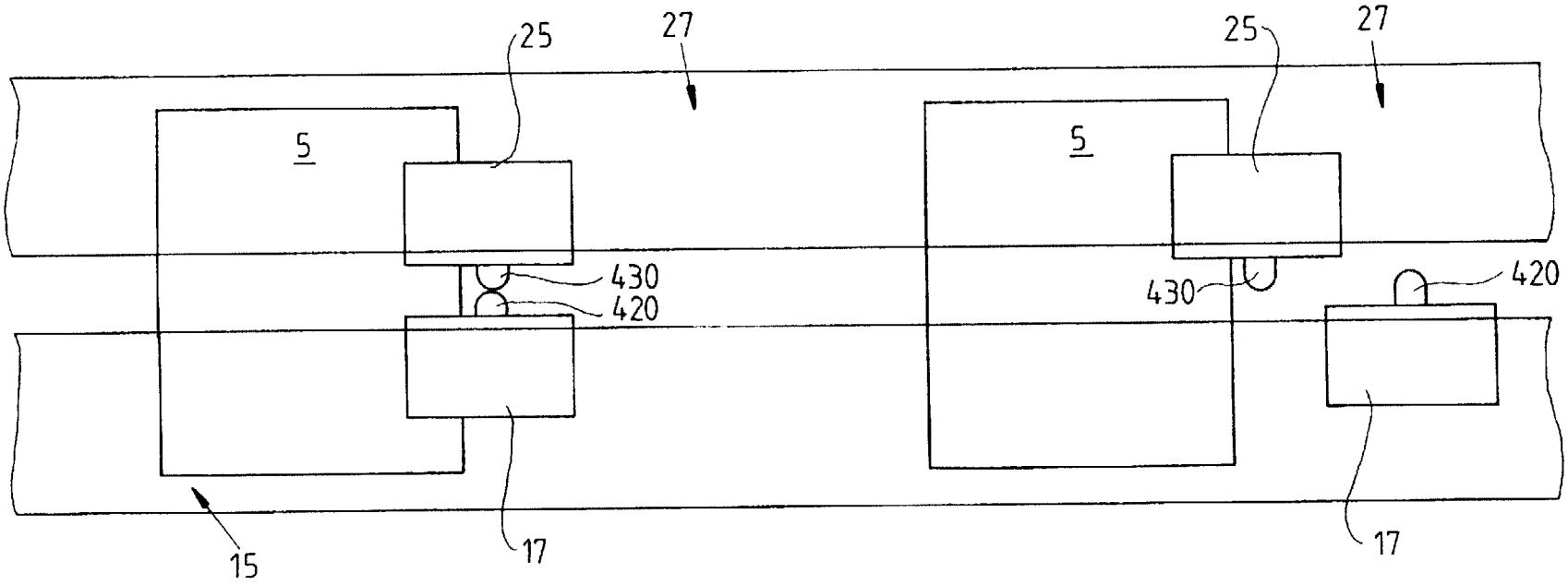

FIG. 3(*a*) shows an enlarged side view of the second transfer area which is located between the reorienting gripper conveyer 14 and the transport conveyor 22. The reorienting gripper conveyer 14 curves upward from below the transport conveyer 22. The reorientation conveyer 14, as described above with regard to FIGS. 1 and 2, has a plurality of rotating gripper elements 17, each of-which seize a signature 5 in a backbone leading configuration. The transport conveyer 22 (which, for example can be a conventional transport single copy conveyor) curves downward from above, and the reorientation conveyer 14 runs substantially parallel to the transport conveyer 22 at a second transfer area 24 having a length 26.

Due to the larger first pitch 16 of the rotatable gripping elements 17 of said reorienting gripper conveyer 14, and the greater relative speed of the reorienting gripper conveyer 14, the rotatable gripping elements 17 overtake the transport grippers 25.

Once the rotatable gripping elements 17 move the seized signature 5 fully into the slower moving transport gripper 25 of said transport conveyer 22, the rotatable gripping element 17 releases control of said signatures 5. Prior to, or simultaneously with, the release by the rotatable gripping element 17, transport gripper 25 closes to capture control of said signature 5. Due to its higher speed, the rotatable gripper elements 17 pull away from the signatures, swinging upward, following its conveying track 15, and completing its loop returning to deceleration unit 6.

The transport conveyer 22 then conveys the signatures 5 in a shingled formation, at the second pitch 23, and subsequently transfers them to post press processing and finishing equipment or different signature release stations (not shown).

Figure 4:
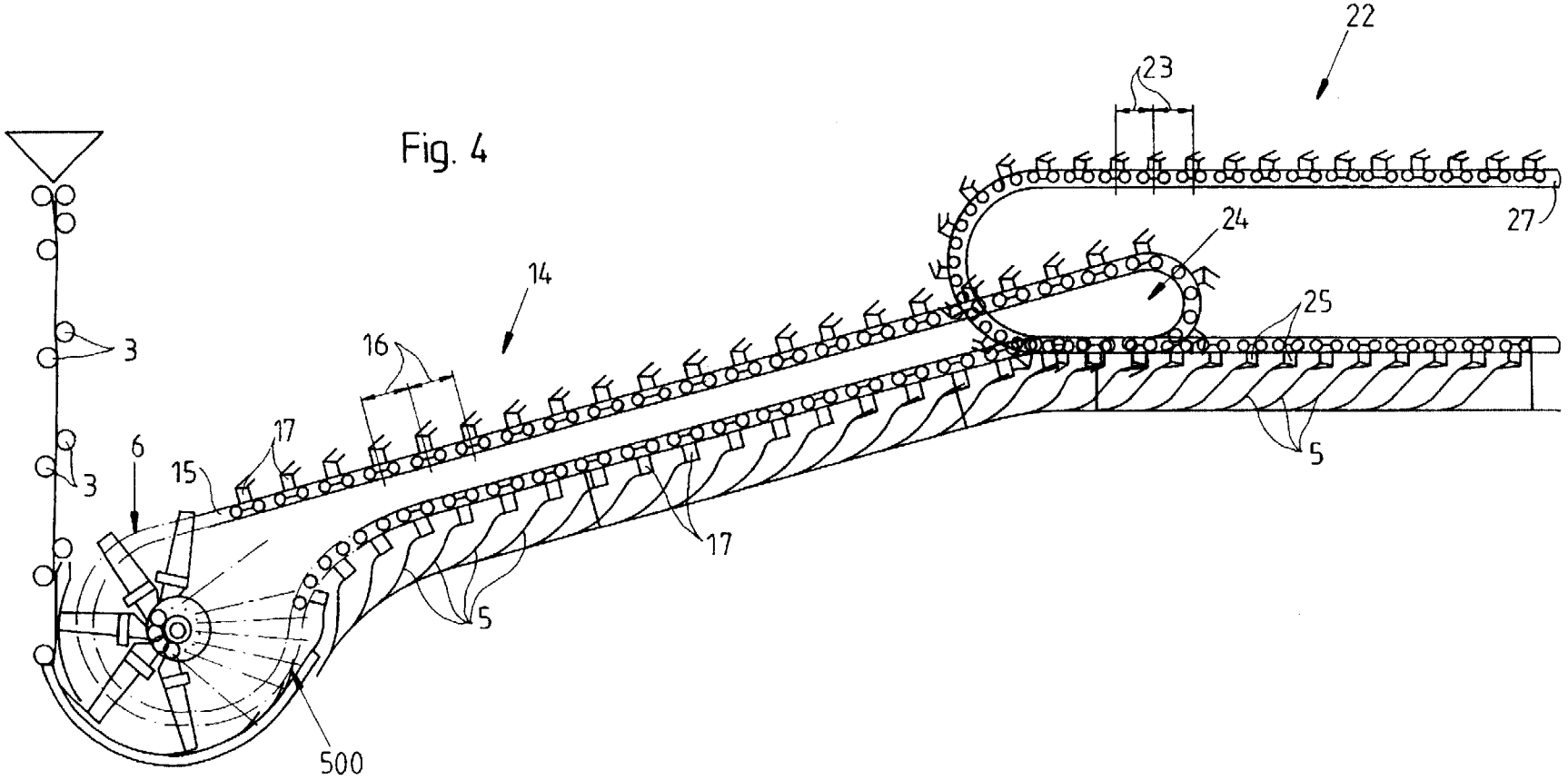
FIG. 4 shows the conveying system of the present invention including the deceleration unit of FIG. 1 and the reorientation and transport mechanisms of FIGS. 2 and 3.

FIG. 4 shows an overall view of the conveying system according to the present invention including the deceleration unit 6, the reorienting gripper conveyer 14, and the transport conveyer 22. As discussed above, the deceleration unit 6 decelerates the signatures 5 from a single spaced configuration into an overlapped shingled configuration. The reorienting gripper conveyer 14 seizes the signatures at the first transfer area 500 and transports the signatures 5 in the shingled configuration, at a first pitch 16, to the second transfer area 24 having the length 26. At the second transfer area 24, the signatures 5 are transferred to the transport conveying system 22, the transport conveying system moving at a slower speed than the reorientation conveyer 14 and having a second pitch 23, which is smaller than the first pitch 16 of the reorienting gripper conveyer 14.

Since the reorientation of seized signatures 5 is performed during conveyance by rotating the rotatable gripper elements 17 by approximately 90°, the signatures 5 remain controlled throughout the reorientation process. The exchange of said signatures 5 onto the transport system 22 is accomplished via different conveyer pitches 16, 23. Since the release of signatures 5 by the reorienting gripper conveyer 14 is actuated after the signatures are being seized by said grippers 25 of said further transport system 22, control of the signatures is also maintained during the re-pacing of the signatures 5.

An exemplary manner in which the grippers 17 rotate the signatures 5, and the manner in which grippers 7, 17, and 25 grip and release the signatures will now be described in greater detail.

Referring to FIGS. 1(*a*), 1(*b*) a first triggering member 300 is mounted along the path of the reorientation conveyer track 15 at a position within the arc-length 50 of the first transfer area 500. Each rotation gripper 17 includes a first actuating member 400 and a second actuating member 410. When the gripper 17 passes the first triggering member 300, the triggering member 300 contacts the first actuating member 400. When contacted by the first triggering member 300, the first actuating member 400 will cause the gripper 17 to grip the signature 5. As an illustration, and referring to FIG. 1(*c*), the first triggering member could be formed as a rounded block, mounted in a stationary position along the path of the reorienting conveyer track 15, and the actuating member 400 could be formed as a spring loaded tab. The gripping motion of the gripper 17 can, for example, be implemented by a spring mechanism, a pneumatic cylinder, or any other suitable mechanism triggered by the first actuating member 400. At the end of the arc length 50, the grippers 7 on the deceleration unit 6 will disengage, and transfer of signature control to reorientation gripper conveyer 14 is complete, with the signatures 5 being gripped by the grippers 17 at their backbone 51.

Referring to FIGS. 2(*a*), 2(*b*), the signatures 5, gripped by the rotating grippers 17, travel along the reorienting conveyer track 15 to the second fixed guide 19. A second trigger member 310 is mounted in a stationary position along the path of the reorienting conveyer track 15. When the gripper 17 passes the second triggering member 310, the second triggering member 310 contacts the second actuating member 410. When contacted by the second triggering member 310, the second actuating member 410 will cause the gripper 17 to rotate 90° in a counter-clock-wise direction as shown in FIG. 2(*b*).

As an illustration, and referring to FIG. 2(*c*), the second triggering member 310 could be formed as a rounded block, mounted in a stationary position along the path of the reorienting conveyer track 15, and the second actuating member 410 could be formed as a spring loaded tab. The rotation of the gripper 17 about the axis 18 (illustrated as a triangle to differentiate it from actuating members 400, 410) can, for example, be controlled by a spring, pneumatic cylinder, or any other suitable device triggered by the second actuating member 410. Once the rotation of the rotation gripper 17 is complete, the signature 5 has been reoriented to a spine leading configuration. A more detailed description of suitable rotation grippers 17 can be found in U.S. application Ser. No. 08/504,868, entitled APPARATUS FOR SPLITTING A PRODUCT STREAM, filed Jul. 20, 1995, the specification of which is hereby incorporated by reference.

Referring to FIG. 3(*a*), when the signatures reach the second transfer area 24, they are gripped by the grippers 25 of the transport conveyer 27. As discussed above, since the reorientation conveyer 14 travels at a greater speed, and has a greater pitch, than the transport conveyer 25, each gripper 17 will overtake a gripper 25 within the length 26 of the second transfer area 24. At the point at which any gripper 17 and gripper 25 are substantially parallel to each other, the gripper 25 will engage, gripping the signature 5. A short time later, but in any event within the transfer area 26, the gripper 17 will release the signature.

As an illustration, and referring to FIG. 3(*b*), a third actuating member 420 is mounted to the rotating gripper 17, and a fourth actuating member 430 is mounted to the gripper 25. When the third actuating member 420 contacts the fourth actuating member 430, depressing both actuating members 420, 430, the gripper 25 is engaged and grips the signature 5. After a short time delay, and before the actuating member 420 moves out of synch with the actuating member 430, the gripper 17 releases the signature 5. Then, since reorienting conveyer 14 is moving faster than the transport conveyer 27, the gripper 17 pulls away from the signature, and, after exiting the second transfer area 24, pulls out of the path of the signatures 5. Consequently, the pitch between overlapped signatures 5 has been reduced while maintaining constant control over the signatures 5.

What is claimed is:

1. An apparatus for delivery of signatures including:

a deceleration unit for receiving signatures, the deceleration unit having a plurality of first grippers, each of the plurality of first grippers seizing a respective signature at a signature seizing area and releasing the respective signature at a first transfer area; and a reorientation mechanism for receiving signatures from the deceleration unit, the reorientation mechanism having a plurality of second grippers, each of the plurality of second grippers seizing a respective signature from the deceleration unit before the respective signature is released by the deceleration unit, reorienting the respective signature to change a leading edge of the respective signature, and then releasing the respective signature at a second transfer area.

2. The apparatus according to claim 1, further comprising:

a transport mechanism for receiving signatures from the reorientation mechanism, the transport mechanism having a plurality of third grippers, each of the plurality of third grippers seizing a respective signature from the reorientation mechanism before the respective signature is released by the reorientation mechanism.

3. The apparatus according to claim 2, wherein the reorientation mechanism further includes a first rotating conveyer following a first conveyer path, each of the second grippers mounted on the rotating conveyer, a first portion of the first conveyer path passing substantially parallel to the first transfer area;

the transport mechanism further including a second rotating conveyer following a second conveyer path, each of the third grippers mounted on the second rotating conveyer, a portion of the second conveyer path passing substantially parallel to the first conveyer path at the second transfer area.

4. The apparatus according to claim 3, wherein the deceleration unit further comprises a plurality of pivot arms rotating around respective pivot axes, each of the respective pivot axes rotating about a single central axis, each of the first grippers mounted to a respective pivot arm and traveling along a deceleration path, the seizing area located at a first arc-length along the deceleration path, the first transfer area located at a second arc-length along the deceleration path.

5. The apparatus according to claim 3, further including a first triggering member mounted in a stationary position along the first conveyer path between the first transfer area and the second transfer area;

each of the plurality of second grippers rotating about a respective axis which is substantially perpendicular to a plane of the first conveyer path, each of the plurality of second grippers further including a first actuation member, the first actuation member being actuated as it passes the first triggering member, each of the plurality of second grippers rotating about its respective axis upon actuation of its respective first actuation member.

6. The apparatus according to claim 5, further including a second triggering member mounted in a stationary position along the first conveyer path in the first transfer area;

each of the plurality of second grippers further including a second actuation member, the second actuation member being actuated as it passes the second triggering member, each of the plurality of second grippers gripping upon actuation of its respective second actuation member.

7. The apparatus according to claim 5, further comprising a fixed guide mounted below the first rotating conveyer, the fixed guide supporting the signatures as the signatures are rotated by the reorientation mechanism.

8. An apparatus for delivery of signatures including:

a deceleration unit for receiving signatures, the deceleration unit having a plurality of first grippers, each of the plurality of first grippers seizing a respective signature at a signature seizing area and releasing the respective signature at a first transfer area; and a reorientation mechanism for receiving signatures from the deceleration unit, the reorientation mechanism having a plurality of second grippers, each of the plurality of second grippers seizing a respective signature from the deceleration unit simultaneously with the release of the respective signature by the deceleration unit, reorienting the respective signature to change a leading edge of the respective signature, each of the plurality of second grippers then releasing the respective signature at a second transfer area.

9. The apparatus according to claim 8, further comprising:

a transport mechanism for receiving signatures from the reorientation mechanism, the transport mechanism having a plurality of third grippers, each of the plurality of third grippers seizing a respective signature from the deceleration unit simultaneously with the release of the respective signature by the reorientation mechanism.

10. The apparatus according to claim 9, wherein the reorientation mechanism further includes a first rotating conveyer following a first conveyer path, each of the second grippers mounted on the rotating conveyer, a first portion of the first conveyer path passing substantially parallel to the first transfer area;

the transport mechanism further including a second rotating conveyer following a second conveyer path, each of the third grippers mounted on the second rotating conveyer, a portion of the second conveyer path passing substantially parallel to the first conveyer path at the second transfer area.

11. An apparatus for delivery of signatures including:

a deceleration unit for individually seizing and slowing down signatures received from a product forming device;

a reorienting conveying system, the reorienting conveying system seizing the signatures from the deceleration unit and reorienting the signatures to change a leading edge of the signatures; and a further conveying system, the further conveying system seizing the signatures from the reorienting conveying system at a common interfacing area.

12. The apparatus according to claim 11 wherein said reorienting conveying system includes a plurality of rotatable gripper elements.

13. The apparatus according to claim 12, wherein said rotatable gripper elements are arranged on a conveying track having a first pitch.

14. The apparatus according to claim 12, wherein said rotatable gripper elements each are rotatable about a pivot axis.

15. The apparatus according to claim 13, wherein a fixed guide is assigned to a section of the conveying track of said reorienting conveying system within which said signatures are reoriented.

16. The apparatus according to claim 15, wherein said signatures are being rotated into a backbone leading configuration.

17. The apparatus according to claim 11, wherein said further conveying system comprises transport grippers spaced apart from each other having a second pitch.

18. The apparatus according to claim 11, wherein said reorienting conveying system and said further conveying system have a common interfacing area.

19. Apparatus according to claim 18, wherein said reorienting conveying system and said further conveying system move substantially parallel to one another within said interfacing area.

20. Apparatus according to claim 13, wherein said further conveying system includes transport grippers spaced apart from each other and having a second pitch, said signatures being moved from said reorienting conveying system into said transport grippers due to a difference between said first and said second pitches.

* * * * *